US011532892B2

(12) United States Patent
Liu et al.

(10) Patent No.: US 11,532,892 B2
(45) Date of Patent: Dec. 20, 2022

(54) PARABOLIC ANTENNA

(71) Applicant: ACCTON TECHNOLOGY CORPORATION, Hsinchu (TW)

(72) Inventors: I-Ru Liu, Hsinchu (TW); Kai-Jia Yeh, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 17/497,361

(22) Filed: Oct. 8, 2021

(65) Prior Publication Data

US 2022/0149537 A1 May 12, 2022

(30) Foreign Application Priority Data

Nov. 12, 2020 (CN) ..... 202022606120.X
May 19, 2021 (CN) ..... 202121071982.5

(51) Int. Cl.
*H01Q 19/12* (2006.01)

(52) U.S. Cl.
CPC ..... *H01Q 19/12* (2013.01)

(58) Field of Classification Search
CPC .... H01Q 19/12; H01Q 19/134; H01Q 19/193; H01Q 15/165
See application file for complete search history.

(56) References Cited

FOREIGN PATENT DOCUMENTS

JP 1065438 A * 3/1998 ..... H01Q 19/12
JP 2016111429 A * 6/2016 ..... H01Q 19/19
JP 2017204748 A * 11/2017 ..... H01Q 19/13

* cited by examiner

*Primary Examiner* — Hoang V Nguyen

(74) *Attorney, Agent, or Firm* — Birch, Stewart, Kolasch & Birch, LLP

(57) ABSTRACT

A parabolic antenna includes a main disc, a transmitting device, and a reflecting member. The main disc has a main surface that is arc-shaped. The transmitting device is disposed on the main disc and includes a transmitter and a reflector. The transmitter corresponds to the reflector. The reflector has a reflecting surface that is arc-shaped and corresponds to the main surface of the main disc. The reflecting member is detachably engaged with the reflecting surface of the reflector and corresponds to the transmitter. By engaging the reflecting member with the reflecting surface of the reflector or detaching the reflecting member from the reflecting surface, the parabolic antenna could form various configurations and provide different reflecting performances.

15 Claims, 14 Drawing Sheets

PARABOLIC ANTENNA

BACKGROUND OF THE INVENTION

Technical Field

The present disclosure relates generally to an antenna structure, and more particularly to a parabolic antenna with a changeable configuration.

Description of Related Art

With the advancement in wireless communications, various antennas have been developed to meet various requirements, and the demand for wireless signal bandwidth and data transmission rates is increasing. Therefore, there is a need for manufacturers to develop an antenna with high peak gain and high wireless transmission rates.

Among all kinds of antennas, dish antennas have an advantage of high gain, but a coverage is relatively narrow, and it must point to a specific direction. A conventional dish antenna 10 is illustrated in FIG. 1, including a disc 12 and a transmitting device 14, wherein the disc 12 has a disc surface 12*a*, and the transmitting device 14 disposed on the disc 12 includes a transmitter 142 and a reflector 144. The reflector 144 has a reflecting surface 144*a*. The reflecting surface 144*a* of the reflector 144 is corresponding to the transmitter 142. The reflecting surface 144*a* is further corresponding to the disc surface 12*a* of the disc 12. When a wireless signal is emitted by the transmitter 142, it is transmitted in a direction toward the reflector 144, in turn, is projected on the reflecting surface 144*a*. Then the wireless signal is reflected to a corresponding area of the disc surface 12*a* by the reflecting surface 144*a* of the reflector 144. Finally, the wireless signal is reflected outward from the disc surface 12*a*.

Although the conventional dish antenna 10 can transmit wireless signals, the transmitting device 14 can only be applied to one size of the disc 12. That is, it is impossible to expand range on the disc surface 12 where the wireless signals are projected on because of restriction of the structure of the reflecting surface 144*a* even the disc 12 is replaced with a larger disc. Therefore, the applicability of the dish antenna 10 is limited.

BRIEF SUMMARY OF THE INVENTION

In view of the above, the primary objective of the present disclosure is to provide a parabolic antenna, which could form different configurations to increase the applicability.

The present disclosure provides a parabolic antenna, including a main disc, a transmitting device, and a reflecting member, wherein the main disc has a main surface which is arc-shaped. The transmitting device is disposed on the main disc and includes a transmitter and a reflector, wherein the transmitter corresponds to the reflector. The reflector has a reflecting surface which is arc-shaped and corresponds to the main surface of the main disc. The reflecting member is detachably engaged with the reflecting surface of the reflector, wherein the reflecting member corresponds to the transmitter.

With the aforementioned design, the reflecting member could be engaged with the reflecting surface of the reflector or be detached from the reflecting surface, so that the parabolic antenna could form various configurations and provide different reflecting performances to increase the applicability.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
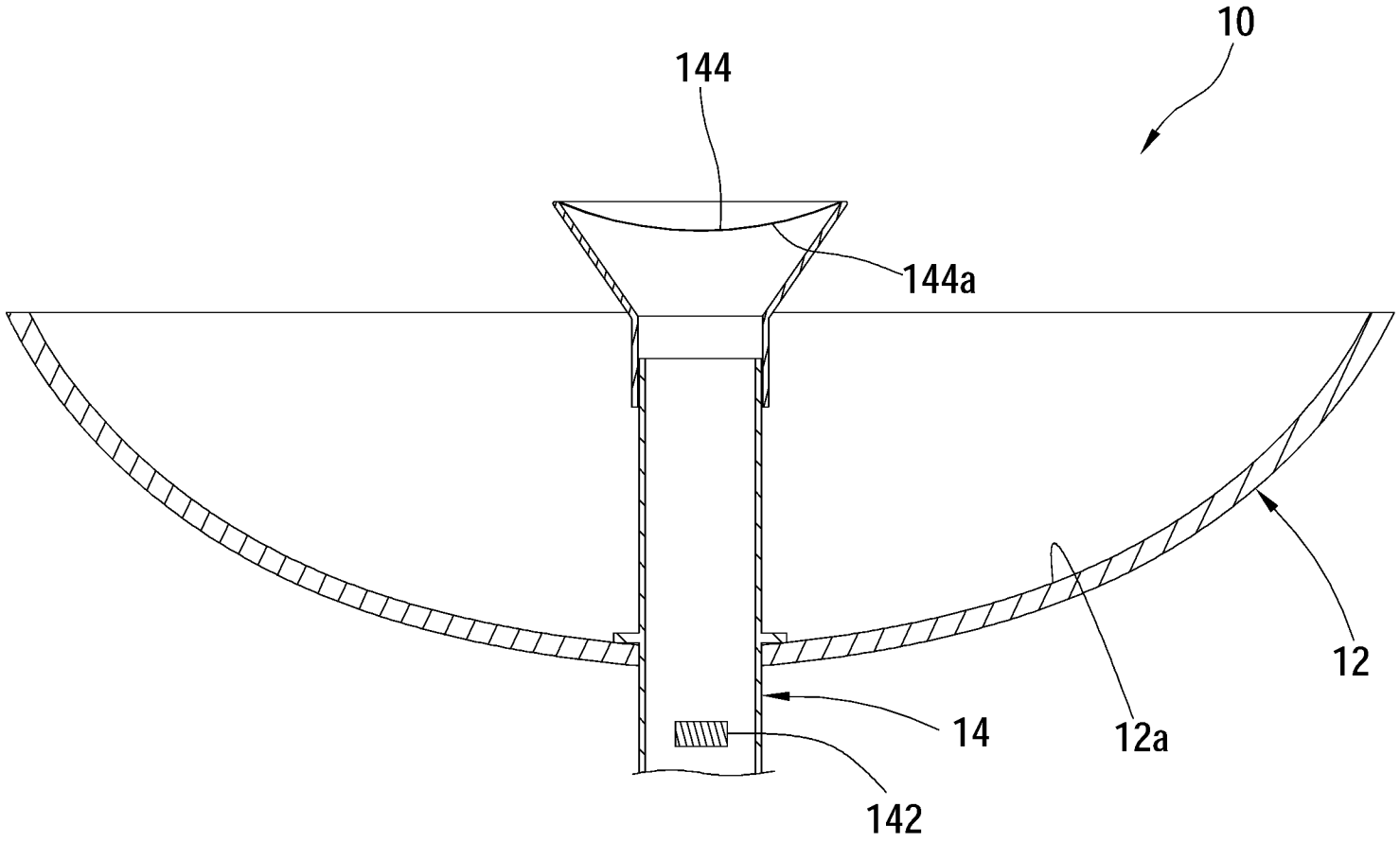
FIG.1 (PRIOR ART)
FIG. 1 is a schematic view of the conventional parabolic antenna.
Figure 2:
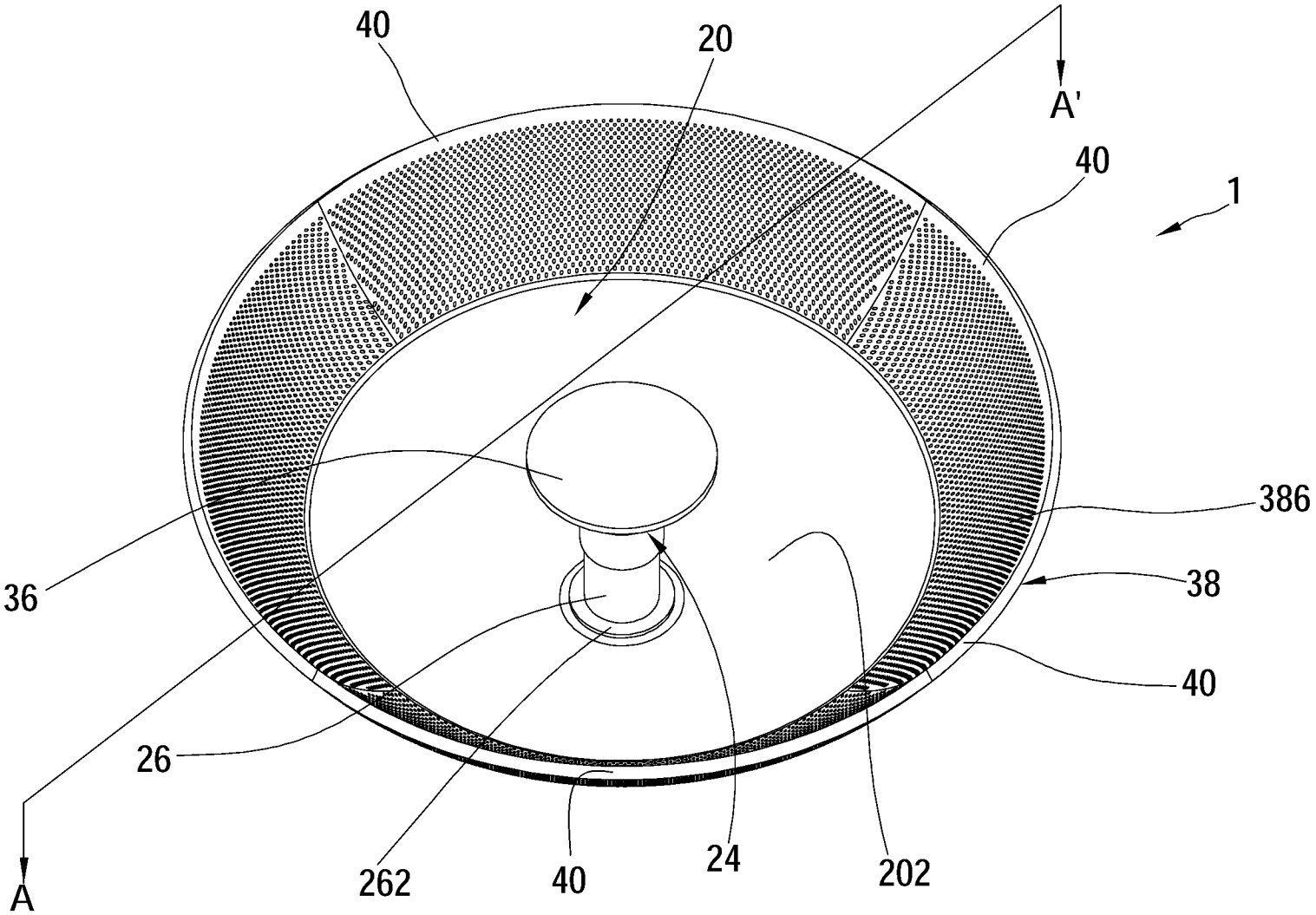
FIG. 2 is a perspective view of the parabolic antenna according to a first embodiment of the present disclosure.
Figure 3:
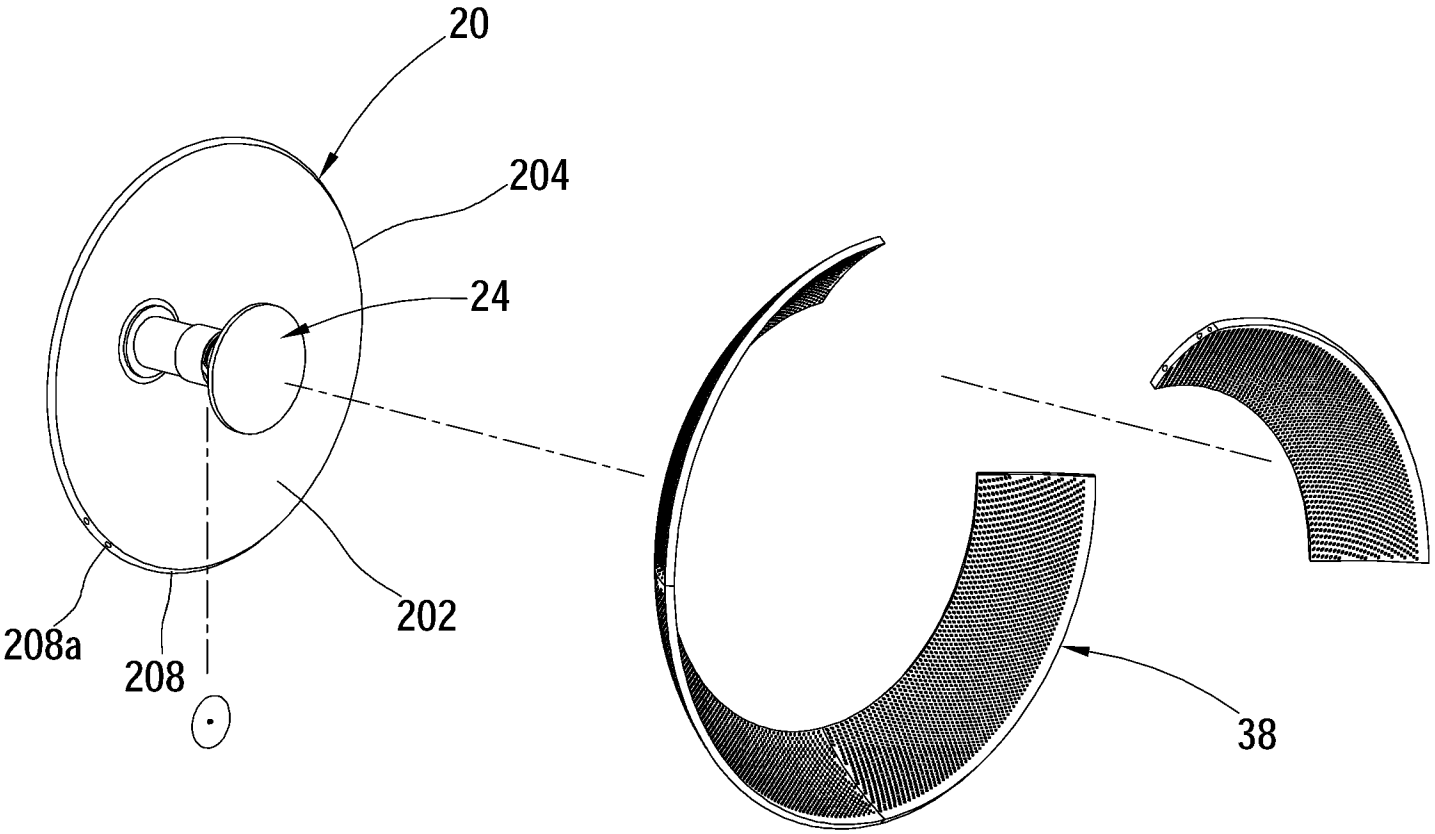
FIG. 3 is a partially exploded view of the parabolic antenna according to the first embodiment of the present disclosure.

A parabolic antenna 1 according to a first embodiment of the present disclosure is illustrated in FIG. 2 to FIG. 10 and includes a main disc 20, a transmitting device 24, an extending disc 38, and a reflecting member 54.

The main disc 20 is made of a metal material and has a main surface 202 with arc-shaped, an open side 204, and an engaging hole 206 disposed on a bottom of the main disc 20. A peripheral portion of the open side 204 has an engaging portion 208 adapted to be engaged with the extending disc 38. In the current embodiment, the engaging portion 208 is an annular flange, wherein a plurality of assembled holes 208*a* is disposed on the annular flange along a circumferential direction of the annular flange. A maximum inner diameter of the main surface 202 is a first inner diameter D1. In the current embodiment, the first inner diameter D1 is 450 mm as an example, but not limited thereto. In addition, in other embodiments, the main surface 202 of the main disc 20 could be selectively configured with mesh holes as could reduce a weight, wind resistance and facilitate drainage.

The transmitting device 24 is disposed on the main disc 20 and includes a wave-guided tube 26, a transmitter 28, and a reflector 30. Preferably, the wave-guided tube 26, the transmitter 28, and the reflector 30 are made of metal or conductive materials. In the current embodiment, a body portion of the wave-guided tube 26 has a flange 262 protruding outward from an outer surface of the body portion along a radial direction of the wave-guided tube 26, so that when a first end of the wave-guided tube 26 passes through the engaging hole 206 of the main disc 20, the flange 262 could be engaged with a periphery of the engaging hole 206 to be fixed. The transmitter 28 is disposed at the first end of the wave-guided tube 26. In the current embodiment, the transmitter 28 includes two exciters in orthogonal configuration. The reflector 30 is disposed relative to the transmitter 28 to reflect a signal sent from the transmitter 28 to a corresponding position. The reflector 30 has a reflecting surface 302 and an opposite surface 304 opposed to the reflecting surface 302. In the current embodiment, the reflecting surface 302 in an arc shape that is convex to the main surface 202 of the main disc 20. The opposite surface 304 faces a direction away from the main surface 202.

In addition, the transmitting device 24 further includes a support 32 which is disposed on a second end of the wave-guided tube 26 opposite to the first end and is adapted to fix the reflector 30 at a predetermined position. The support 32 includes a plurality of supporting rods 322 between which a plurality of hollow portions 324 is formed. In the current embodiment, the hollow portions 324 are located between the reflector 30 and the wave-guided tube 26 in a longitudinal axis direction of the wave-guided tube 20. In the current embodiment, the transmitting device 24 further includes a cover 34 which fits around the second end of the wave-guided tube 26 and is adapted to seal an opening of the wave-guided tube 26, thereby preventing foreign matter or water from entering the wave-guided tube 26. The reflector 30 also provides with a cover 36 which covers the opposite surface 304, thereby preventing the opposite surface 304 from accumulating water. Preferably, the cover 34 of the transmitting device 24 and the cover 36 of the reflector 30 are made of a non-metal material, such as plastic.

The extending disc 38 has a first open side 382, a second open side 384, and an extending surface 386 located between the first open side 382 and the second open side 384, wherein an inner diameter of the extending disc 38 gradually increases from the first open side 382 toward the second open side 384. The first open side 382 is detachably engaged with the open side 204 of the main disc 20. A maximum inner diameter of the extending surface 386 is a second inner diameter D2, wherein the second inner diameter D2 is greater than the first inner diameter D1. In the current embodiment, the second inner diameter D2 is, but not limited to, 650 mm. Preferably, the extending disc 38 is made of metal or conductive materials. In the current embodiment, the extending disc 38 is formed by splicing a plurality of curved plates 40 along a circumferential direction. However, in other embodiments, the extending disc 38 could be an annular curved plate integrally formed as a monolithic unit. Each of the curved plates 40 has a curved surface, wherein the curved surfaces 42 of the curved plates 40 constitutes the extending surface 386. In other embodiments, the extending surface 386 could be selectively configured with mesh holes as could reduce a weight of the extending disc 38, reduce wind resistance, and facilitate drainage.

Two opposite sides of each of the curved plates 40 respectively have a first engaging portion 401 and a second engaging portion 402. The first engaging portion 401 of each of the curved plates 40 is engaged with the second engaging portion 402 of an adjacent one of the curved plates 40. In the current embodiment, the first engaging portion 401 includes a first folding edge 44 while the second engaging portion 402 includes a second folding edge 46. The first folding edge 44 of each of the curved plates 40 is adjacent to the second folding edge 46 of another one of the curved plates 40. Each of the first folding edges 44 and each of the second folding edges 46 respectively have at least one assembled hole 442, 462. The first folding edge 44 and the second folding edge 46 which are adjacent are engaged with each other by passing an engaging member 50 through the corresponding assembled holes 442, 462. In the current embodiment, each of the engaging members 50 includes a bolt 502 and a nut 504.

To increase a convenience of assembly, in the current embodiment, the first folding edge 44 of each of the curved plates 40 is provided with at least one positioning member 52, and the second folding edge 46 of each of the curved plates 40 is provided with at least one positioning hole 464. In the current embodiment, the number of the at least one positioning member 52 on the first folding edge 44 of the first engaging portion 401 of each of the curved plates 40 is two, and the number of the at least one positioning hole 464 on the second folding edge 46 of the second engaging portion 402 of each of the curved plates 40 is two The positioning members 52 on each of the first folding edges 44 respectively penetrates through the positioning holes 464 of the adjacent one of the second folding edges 46. In the current embodiment, each of the positioning members 52 has a head portion 522 and a body portion 524. An end of the body portion 524 of each of the positioning members 52 is engaged with the first folding edge 44. Each of the positioning holes 464 has a first section 464*a* and a second section 464*b* with which the first section 464*a* communicates. An outer diameter of the head portion 522 of each of the positioning members 52 is smaller than a diameter of each of the first sections 464*a* and is greater than a diameter of each of the second sections 464*b*.

Figure 6:
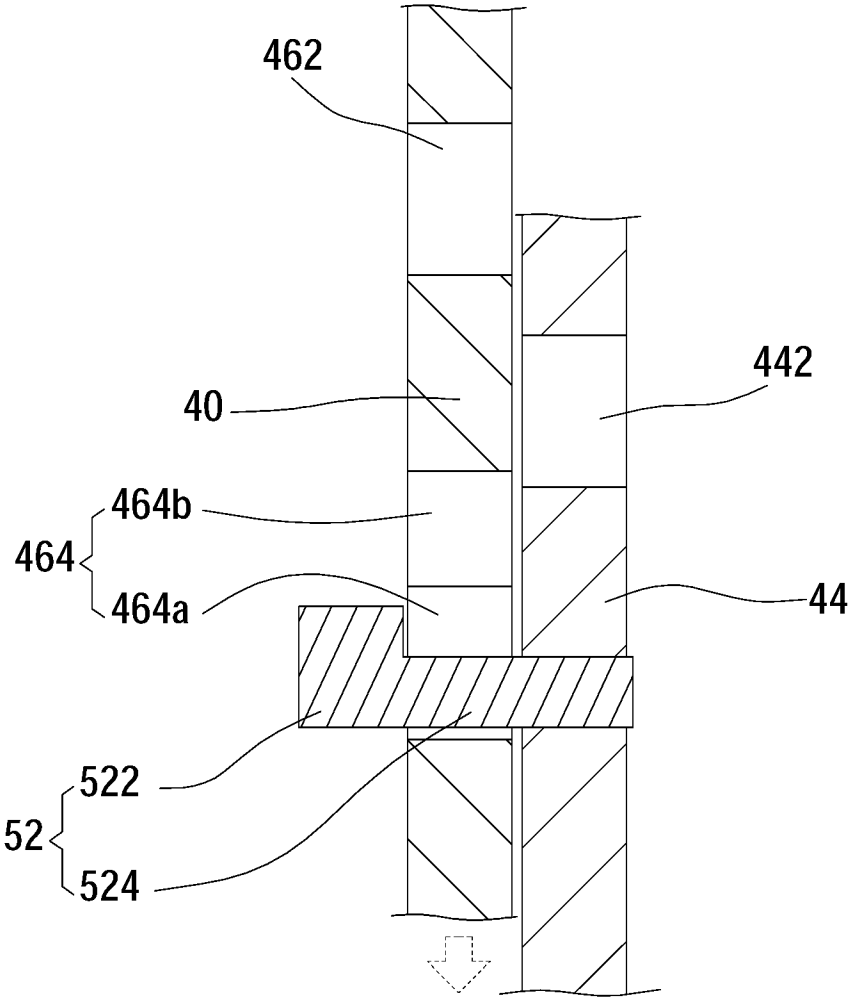
FIG. 6 is a schematic view, showing the assembling process of the two extending discs according to the first embodiment of the present disclosure.
Figure 7:
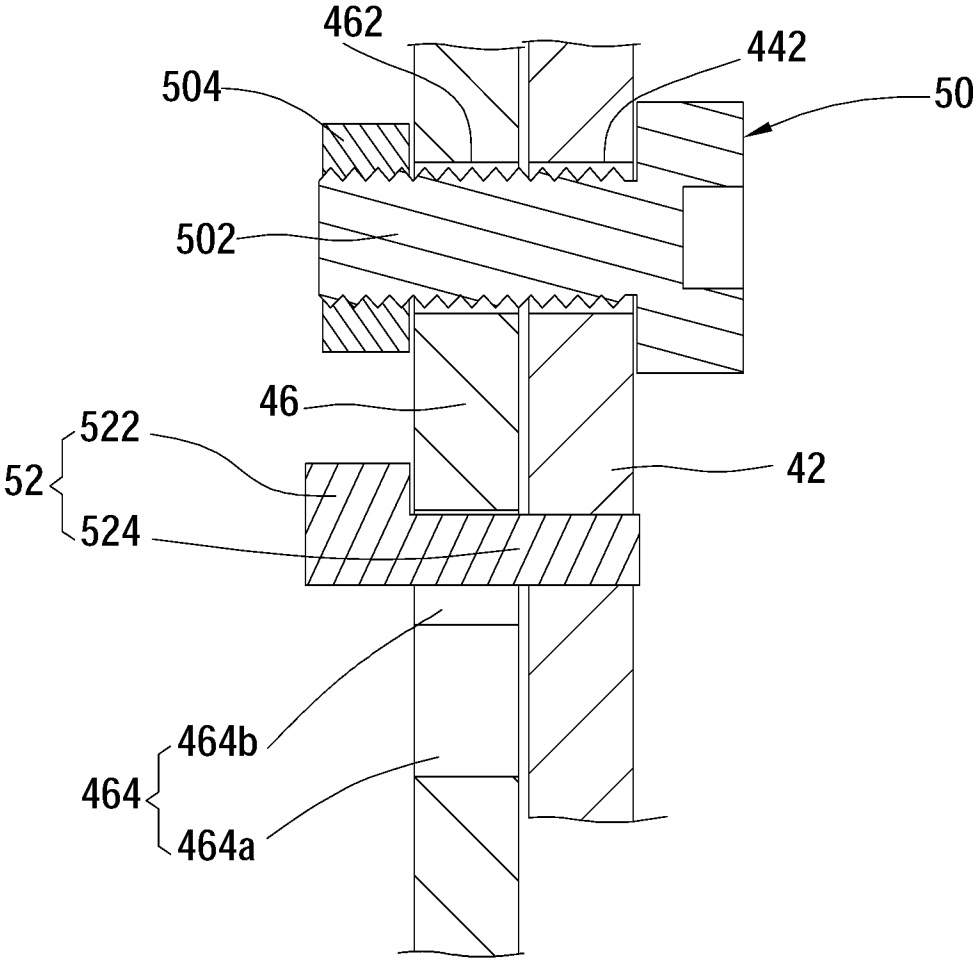
FIG. 7 is a schematic view, showing the two extending discs are assembled.

During a process of assembling, at first, the head portion 522 of each of the positioning members 52 on each of the first folding edges 44 penetrates through the first section 464*a* of the adjacent one of the second folding edges 46 to be located at an outside of the first section 464*a* (as shown in FIG. 6). Then, the curved plates 40 which are adjacent each other are moved relative to each other to correspondingly move the body portion 524 of each of the positioning members 52 to the second section 464*b* and to abut the body portion 524 against a wall of the second section 464*b*. The head portion 522 of each of the positioning members 52 is located at an outside of the corresponding second section 464*b*, thereby to align the two assembled holes 442, 462 and to keep two adjacent curved plates 40 from separating before being fixed. After that, referring to FIG. 7, the bolt 502 correspondingly penetrates through the assembled holes 442, 462, and the nut 504 is fastened to the bolt 502 to fix the two adjacent curved plates 40.

Each of the curved plates 40 further has a third engaging portion 403 located between the first engaging portion 401 and the second engaging portion 402. The third engaging portion 403 forms an engaging portion of the extending disc 38 and is engaged with the engaging portion 208 of the main disc 20. In the current embodiment, the third engaging portion 403 includes a third folding edge 48 connected between the first folding edge 44 and the second folding edge 46. The third folding edge 48 has at least one assembled hole 482. The assembled hole 482 of each of the third folding edges 48 corresponds to one of the assembled holes 208*a* of the engaging portion 208 of the main disc 20 for being detachably engaged with another engaging member (e.g. bolt and nut).

Figure 8:
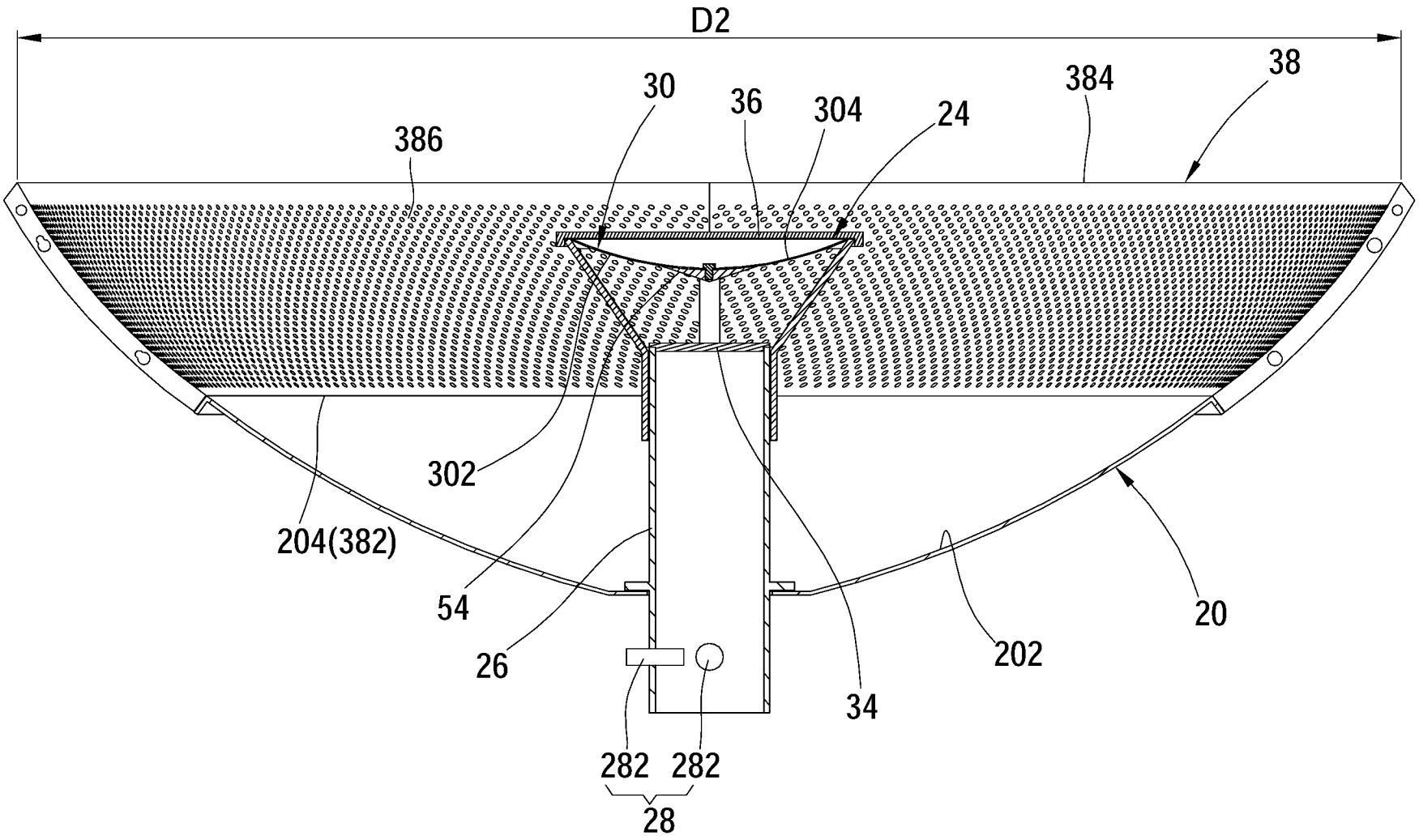
FIG. 8 is a sectional schematic view along the A-A' line in FIG. 2, showing the second configuration of the parabolic antenna according to the first embodiment of the present disclosure.
Figure 9:
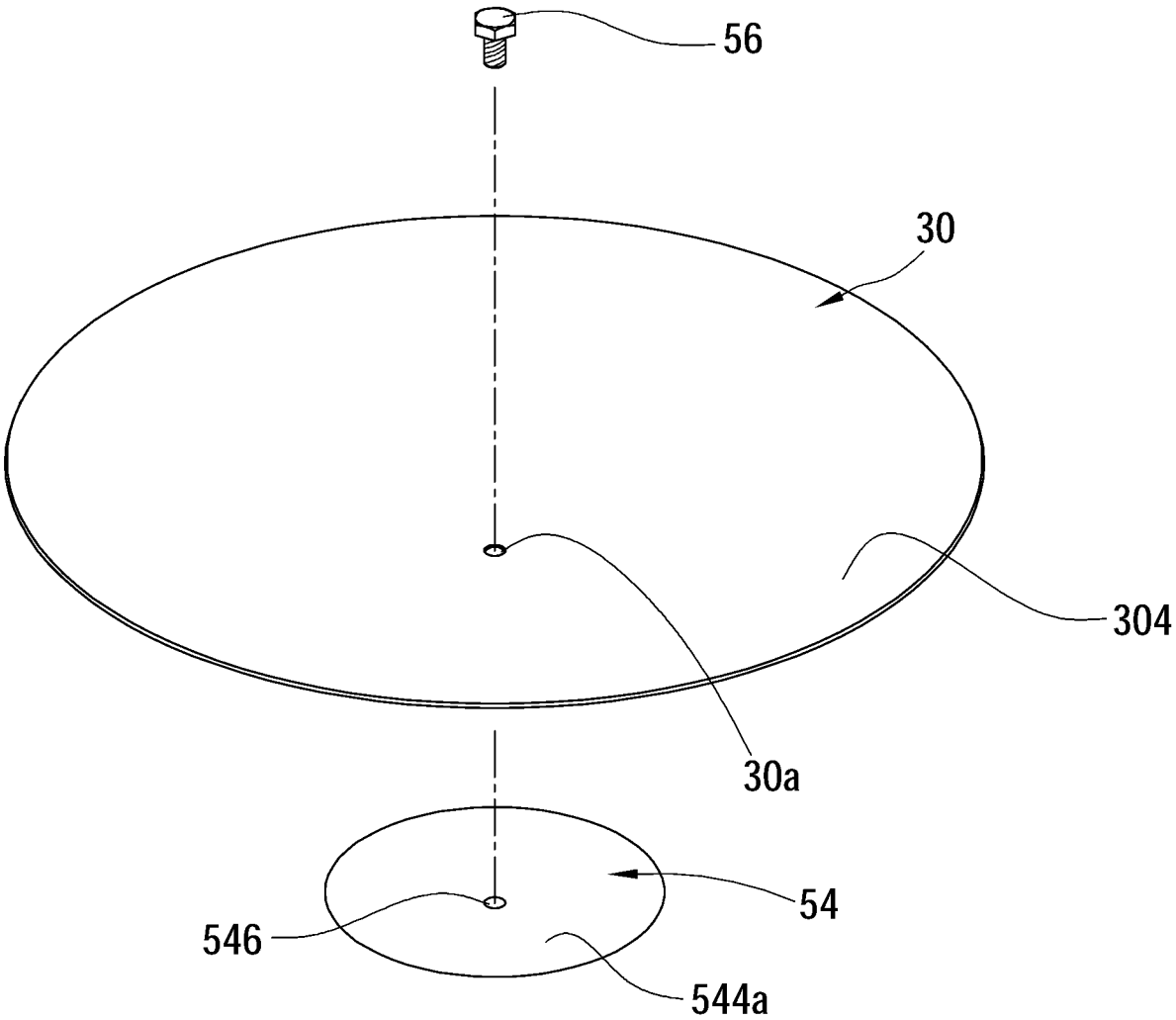
FIG. 9 is an exploded view of the reflector and the reflecting member according to the first embodiment of the present disclosure.
Figure 10:
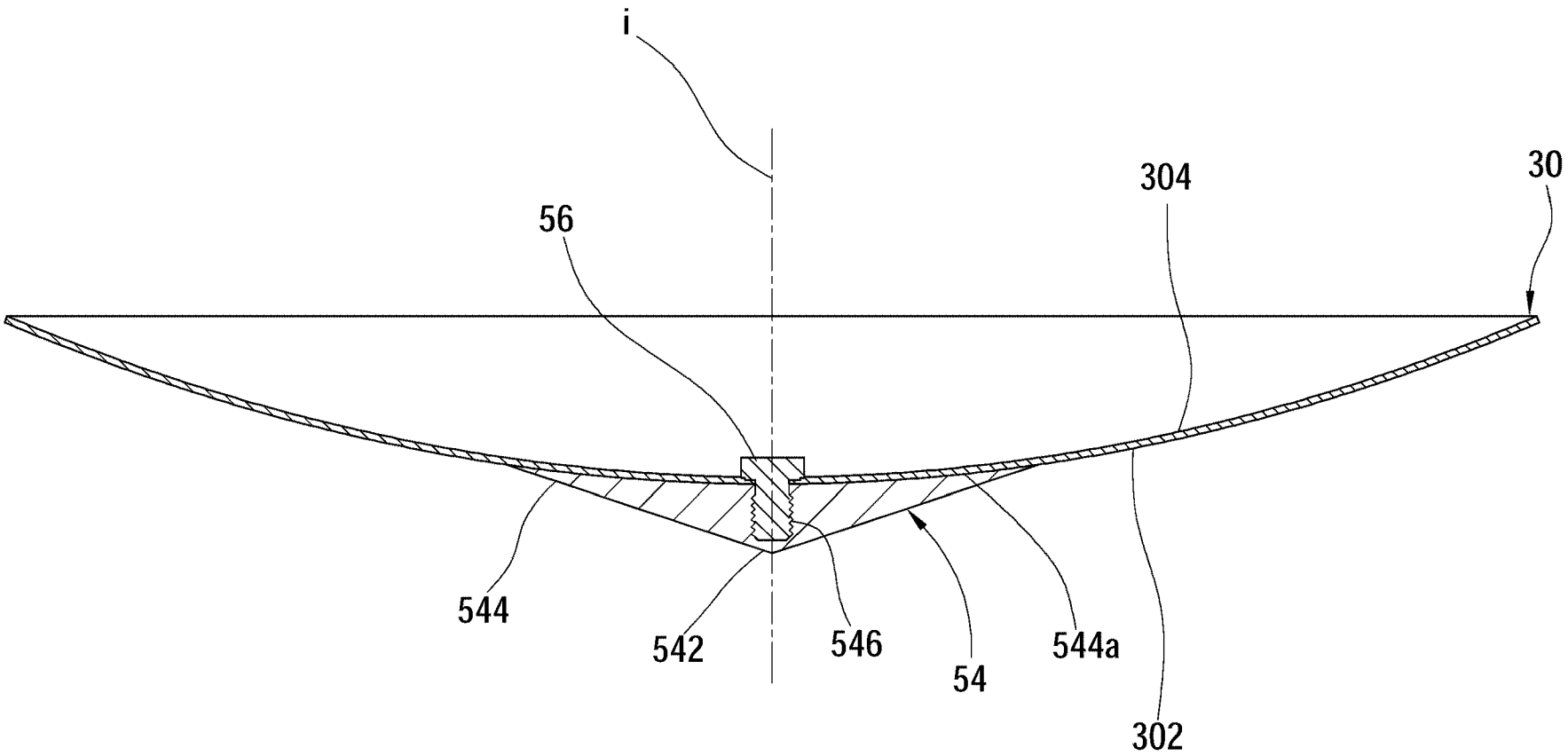
FIG. 10 is a sectional schematic view of the reflector and the reflecting member according to the first embodiment of the present disclosure.

Referring to FIG. 8 to FIG. 10, the reflecting member 54 is made of metal and is detachably engaged with the reflecting surface 302 of the reflector 30. The location of the reflecting member 54 corresponds to the extending surface 386 及 and the transmitter 28. In the current embodiment, the reflecting member 54 has a first end 542 and a second end 544 opposed to the first end 542. The first end 542 faces toward an inside of the wave-guided tube 26. The second end 544 faces toward the reflecting surface 302 of the reflector 30. An outer diameter of the reflecting member 54 increases gradually from the first end 542 toward the second end 544 of the reflecting member 54. In the current embodiment, the reflecting member 54 is, but not limited to, conical. In other embodiments, an outer peripheral surface of the reflecting member 54 could be a gradually-expand curved surface.

The second end 544 of the reflecting member 54 has an attaching surface 544*a* abutting against the reflecting surface 302, wherein a shape of the attaching surface 544*a* is complementary to that of the reflecting surface 302 of the reflector 30. Referring to FIG. 10, to illustrate easily, in the current embodiment, the reflector 30 is defined with an axis i thereon which passes through a center of the first end 542 and a center of the second end 544 and extends along the longitudinal axis direction of the wave-guided tube 26.

The parabolic antenna 1 further includes a fixing mechanism with which the reflecting member 54 and the reflecting surface 302 are fixed. In the current embodiment, the reflector 30 has a through-hole 30*a* penetrating through the reflecting surface 302 and the opposite surface 304. The reflecting member 54 has a fixing hole 546 corresponding to the through-hole 30*a*. The axis i passes through the through-hole 30*a* and the fixing hole 546. A fixing member 56 passes through the through-hole 30*a* to be engaged with the fixing hole 546, thereby the reflecting member 54 is fixed on the reflecting surface 302. The through-hole 30*a*, the fixing hole 546, and the fixing member 56 constitute the fixing mechanism of the current embodiment. In the current embodiment, the fixing hole 546 is a threaded hole as an example, and the fixing member 56 is a bolt as an example, however, these are not a limitation of the present disclosure. In other embodiments, the fixing hole 546 could be a circular hole, and the fixing member 56 could be a fixing pin that could be detachably engaged with the fixing hole 546.

Figure 4:
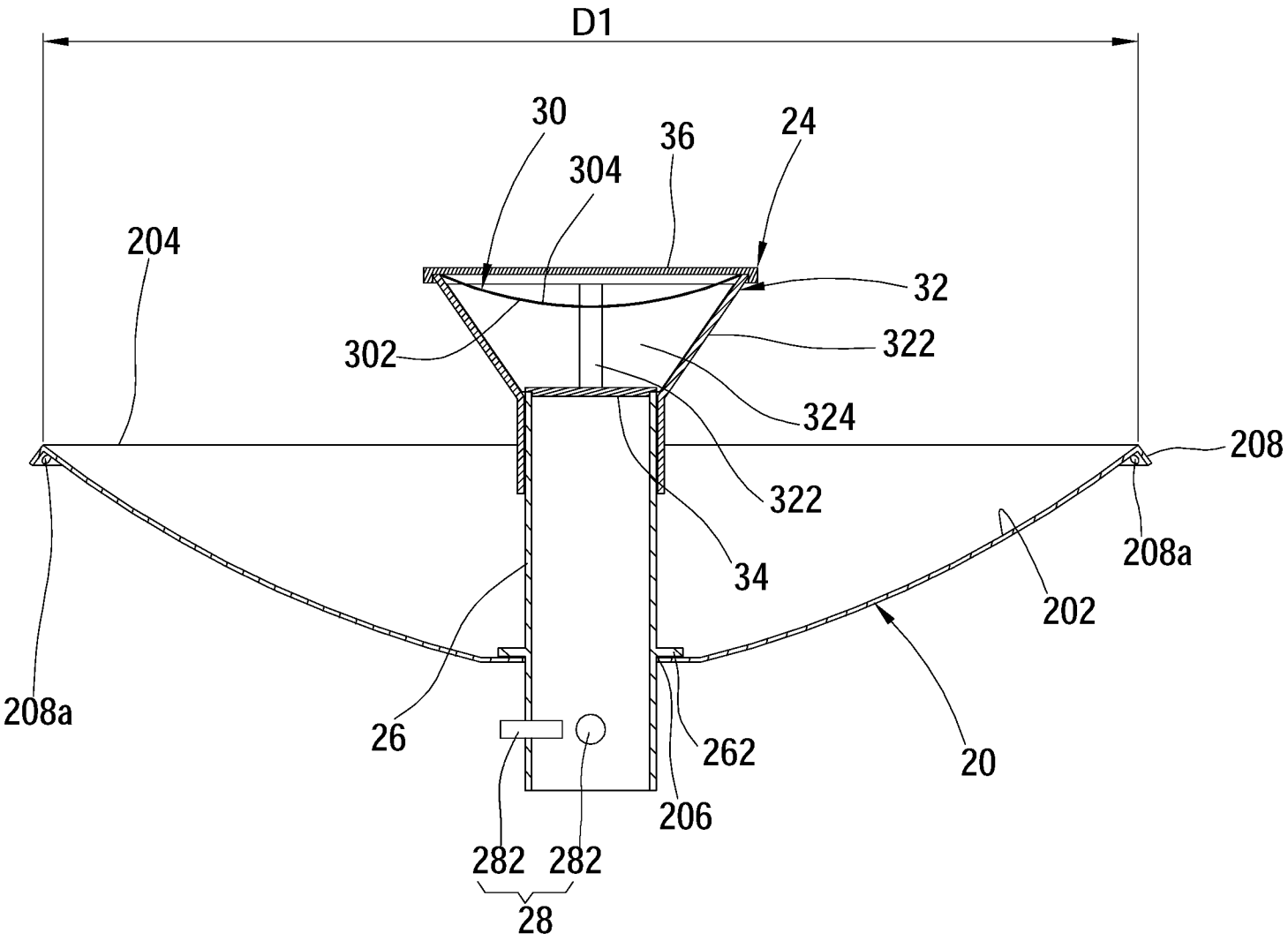
FIG. 4 is a sectional schematic view along the A-A' line in FIG. 2, showing the first configuration of the parabolic antenna according to the first embodiment of the present disclosure.
Figure 5:
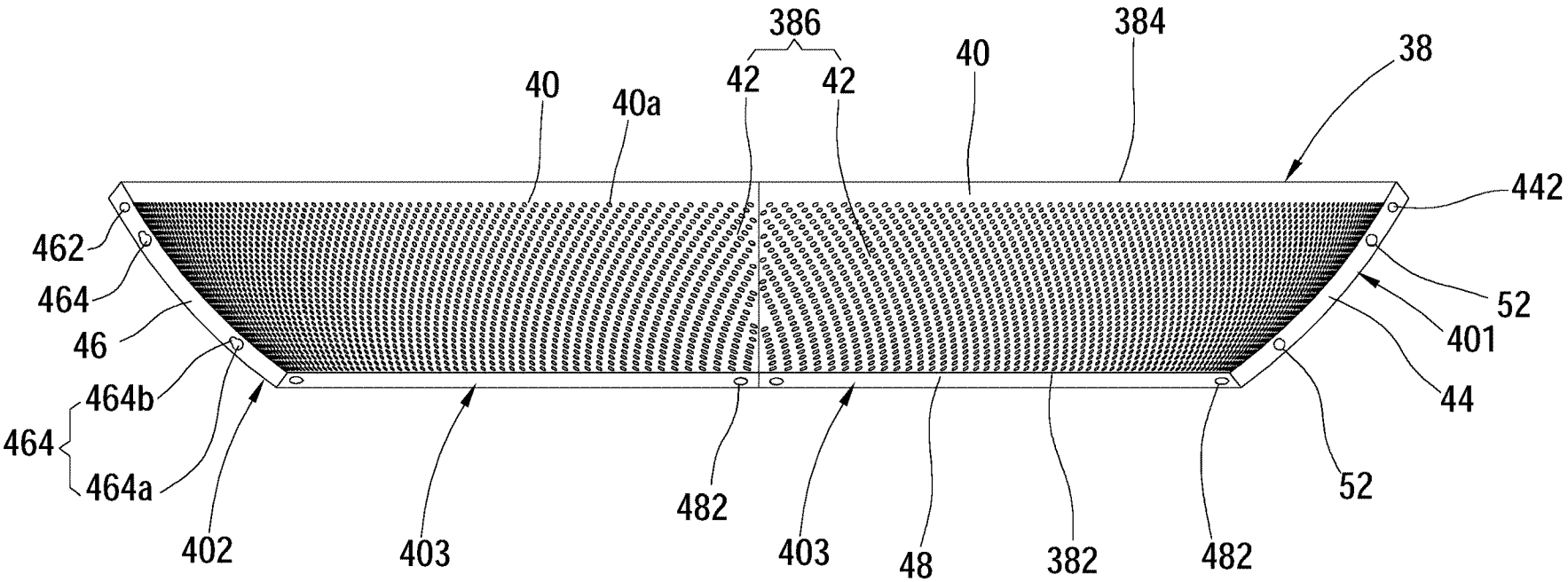
FIG. 5 is a partial side view of the extending disc according to the first embodiment of the present disclosure.

The parabolic antenna 1 could be assembled to two different configurations including a first configuration shown in FIG. 4 and a second configuration shown in FIG. 8. The main disc 20 without extending disc 38 attached and the reflecting member 54 without reflecting surface 302 attached form the first configuration shown in FIG. 4. Since the support 32 has the hollow portions 324 between the reflector 30 and the wave-guided tube 26, the reflecting member 54 could be easily taken via the hollow portions 324 when the reflecting member 54 is about to be detached. When the parabolic antenna 1 is in the first configuration, a wireless signal sent from the transmitter 28 could be sent in a direction from the wave-guided tube 26 toward the reflector 30. So that the wireless signal could be correspondingly projected onto the reflecting surface 302 and be correspondingly reflected by the reflecting surface 302 to the main surface 202 of the main disc 20. Therefore, the wireless signal can be reflected outward from the main surface 202.

Alternatively, the main disc 20 with the extending disc 38 attached, and the reflecting member 54 with the reflecting surface 302 attached form the second configuration shown in FIG. 8. When the parabolic antenna 1 is constituted by the second configuration, a wireless signal sent from the transmitter 28 could be sent in a direction from the wave-guided tube 26 toward the reflector 30, wherein a part of the wireless signal is correspondingly projected onto the reflecting surface 302 and is correspondingly reflected by the reflecting surface 302 to the main surface 202 of the main disc 20. Therefore, the wireless signal is reflected outward from the main surface 202. While another part of the wireless signal is correspondingly projected onto the reflecting member 54 and is correspondingly reflected by the reflecting member 54 to the extending surface 386 of the extending disc 38 by the outer peripheral surface of the reflecting member 54 and is reflected outward from the extending surface 386. That is to say, the main surface 202 of the main disc 20 and the extending surface 386 of the extending disc 38 can form a larger surface. In this way, by utilizing the extending disc 386 in conjunction with the reflecting member 54, the wireless signal sent from the parabolic antenna 1 could not only have a directivity but also increase a coverage.

Figure 11:
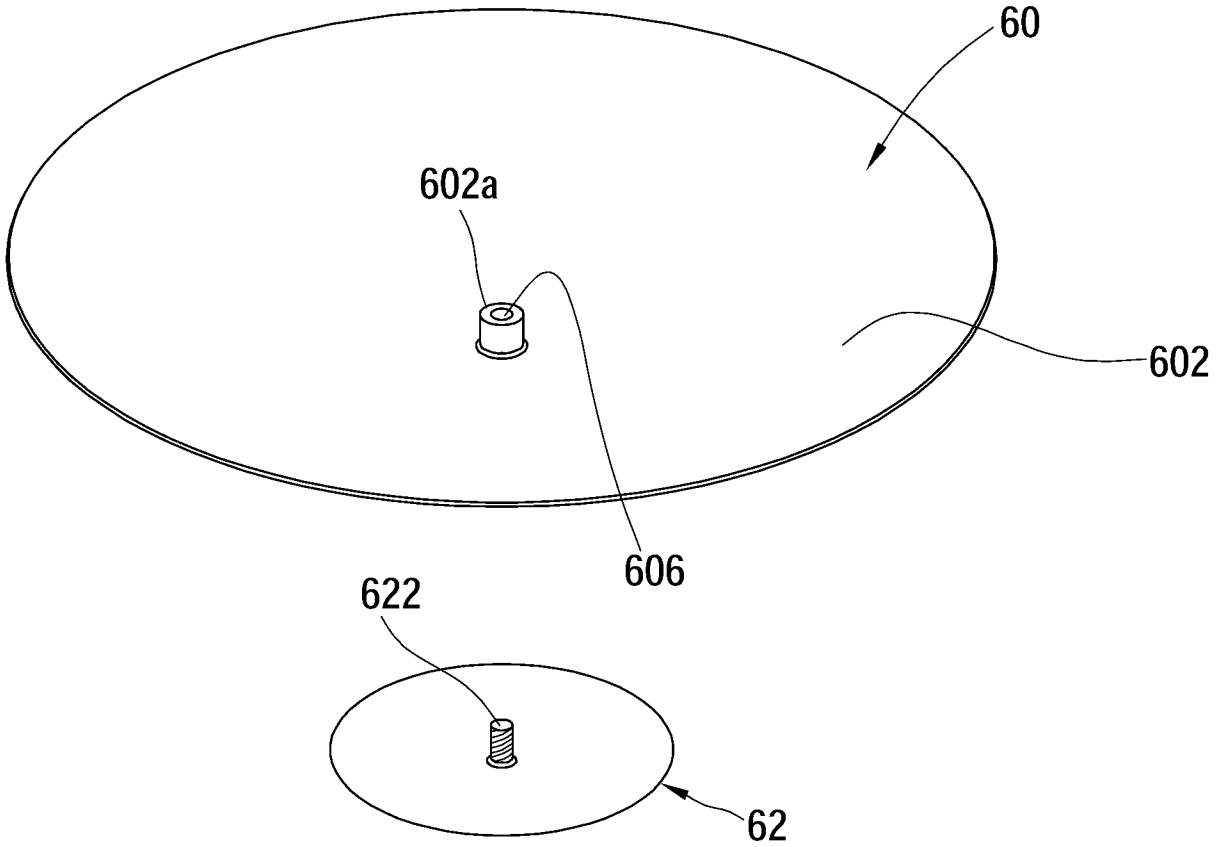
FIG. 11 is an exploded view of the reflector and the reflecting member according to a second embodiment of the present disclosure.
Figure 12:
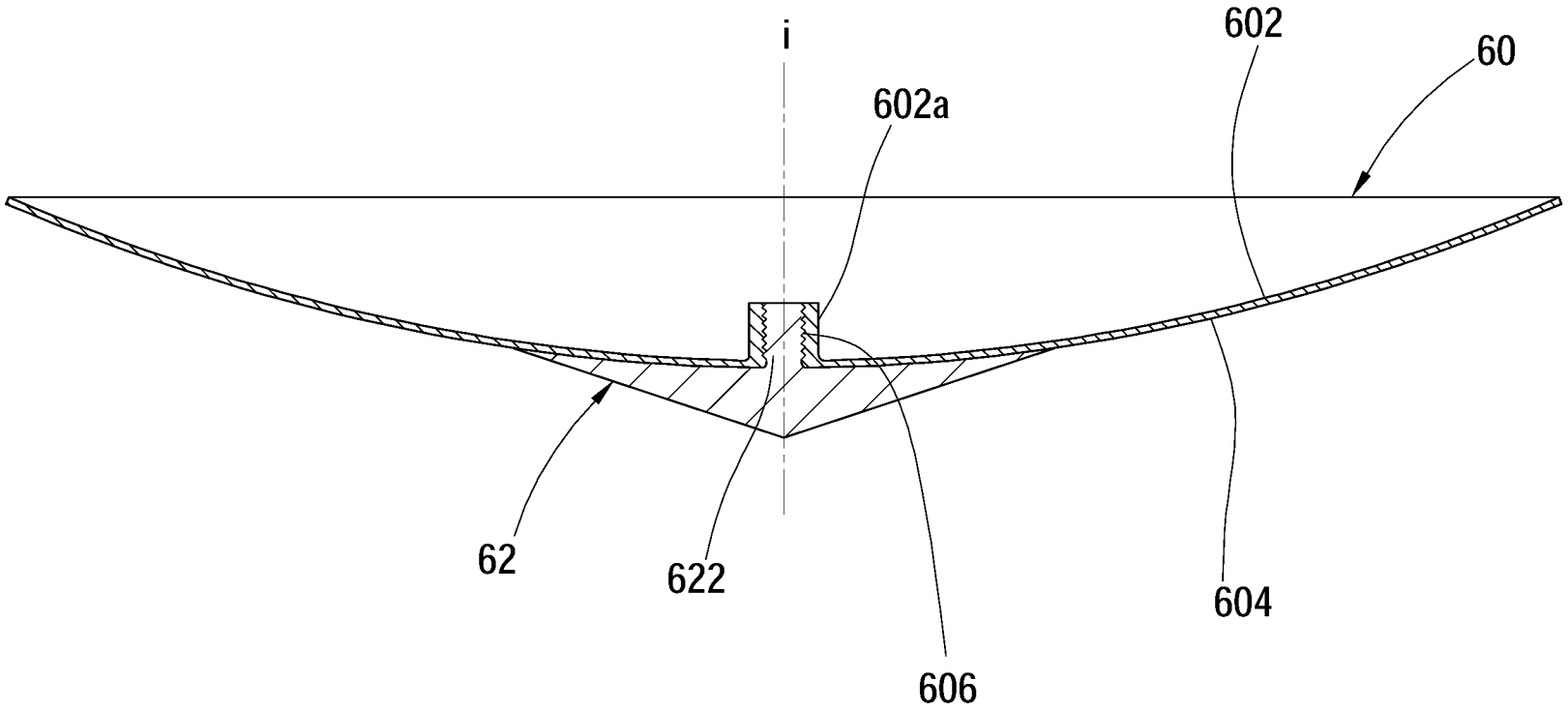
FIG. 12 is a sectional schematic view of the reflector and the reflecting member according to the second embodiment of the present disclosure.

A reflector 60 and a reflecting member 62 configured in a parabolic antenna according to a second embodiment are illustrated in FIG. 11 and FIG. 12, which has almost the same structure as that of the first embodiment, except the fixing mechanism. More specifically, a protrusion 602*a* is disposed on an opposite surface 602 of the reflector 60 while a fixing hole 606 is disposed on the reflector 60, wherein the fixing hole 606 extends from a reflecting surface 604 of the reflector 60 through the protrusion 602*a*.

The reflecting member 62 has a fixing rod 622, wherein an axis i passing through a center of the fixing hole 606 and a center of the fixing rod 622 is defined on the reflecting member 62. The fixing rod 622 is disposed in the fixing hole 606 to fix the reflecting member 62 to the reflecting surface 604. The fixing hole 606 and the fixing rod 622 constitute the fixing mechanism of the current embodiment.

In the current embodiment, the fixing hole 606 is a threaded hole as an example, and the fixing rod 622 has an external thread, so that the fixing rod 622 could be screwed into the fixing hole 606; however, these are not a limitation of the present disclosure. In other embodiments, the fixing rod 622 could be circular or a shape complementary to that of the fixing hole 606, which could achieve detachable engagement as well.

Figure 13:
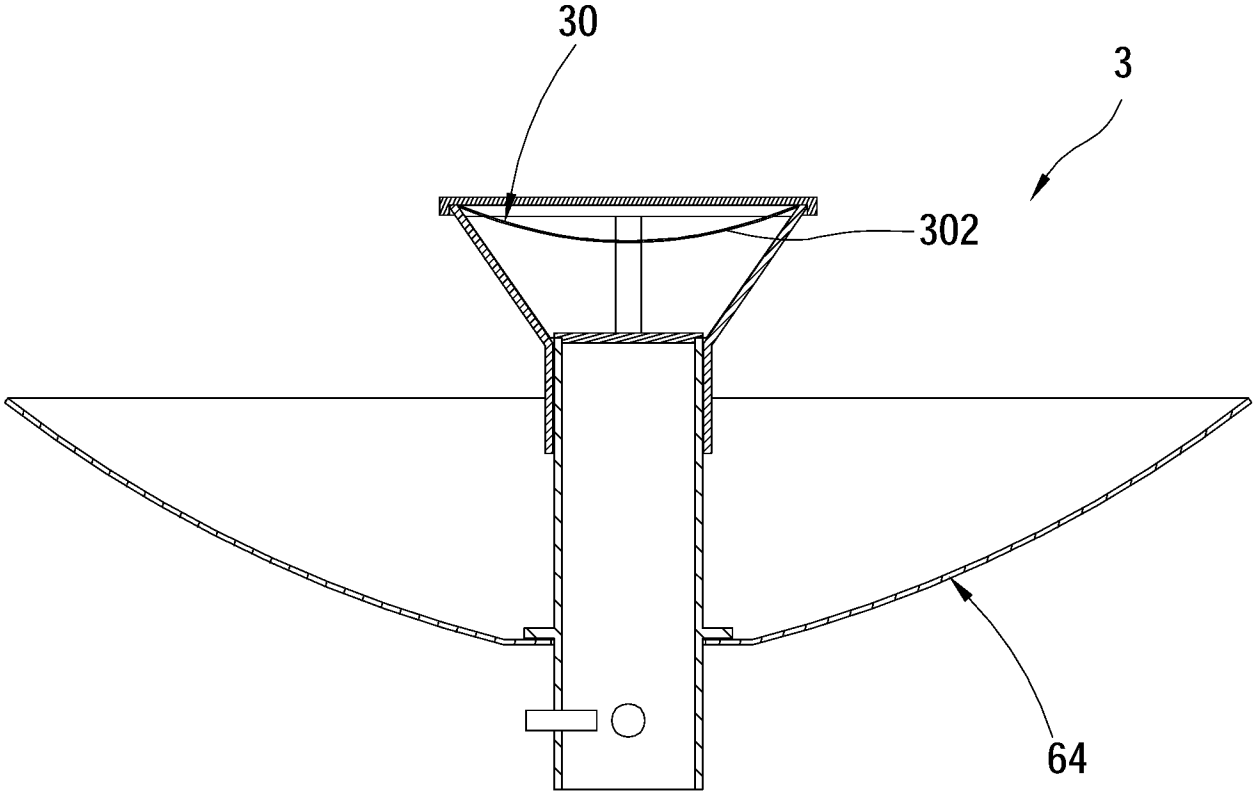
FIG. 13 is a sectional schematic view, showing the first configuration of the parabolic antenna according to a third embodiment of the present disclosure.
Figure 14:
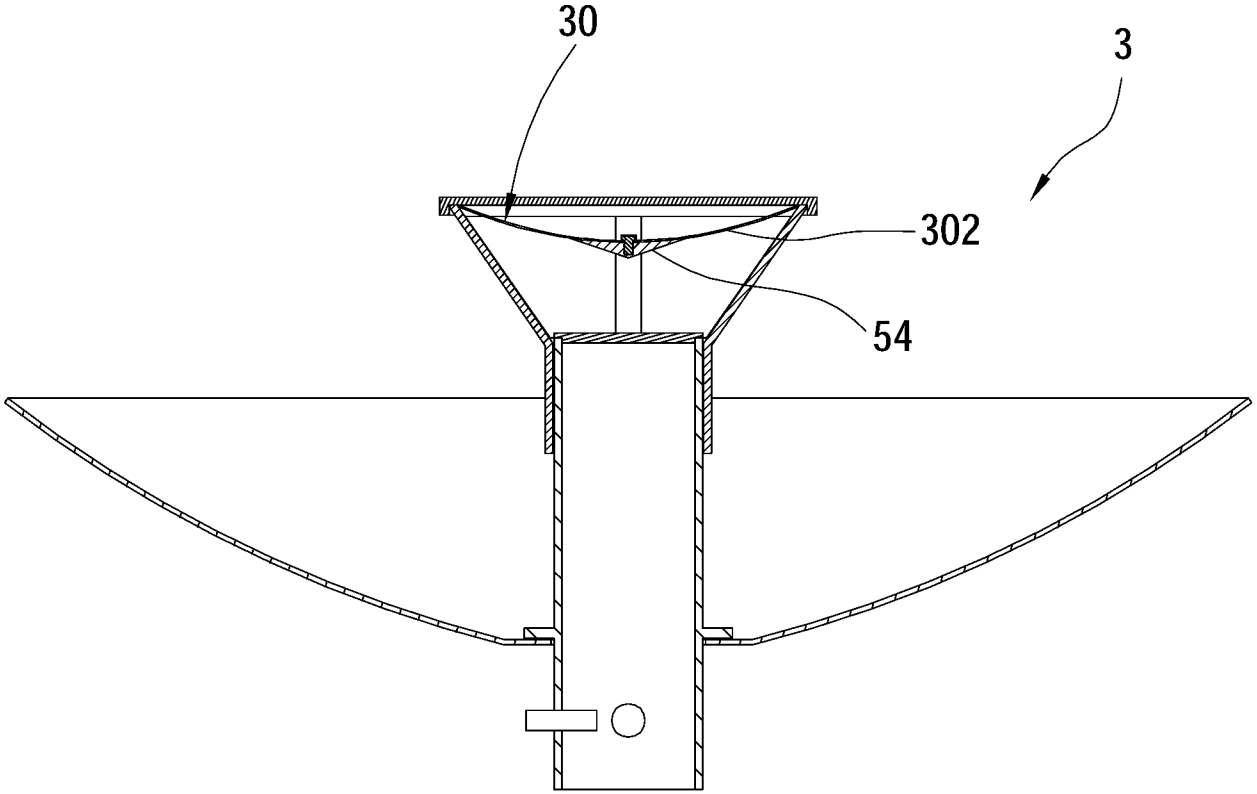
FIG. 14 is a sectional schematic view, showing the second configuration of the parabolic antenna according to the third embodiment of the present disclosure.

A parabolic antenna 3 according to a third embodiment is illustrated in FIG. 13 and FIG. 14, which has almost the same structure as that of the first embodiment, except that a main disc 64 of the parabolic antenna 3 is not connected to the extending disc. As shown in FIG. 13, the reflecting member 54 could be detached from the reflecting surface 302 of the reflector 30. Alternatively, as shown in FIG. 14, the reflecting member 54 could be engaged with the reflecting surface 302 of the reflector 30. In this way, the parabolic antenna 3 could provide different configurations as well, providing different reflecting performances. In the current embodiment, main discs with different maximum inner diameters could also be selected according to requirements.

For main discs with a larger inner diameter, the reflecting member 54 could be engaged with the reflecting surface 302 of the reflector 30.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A parabolic antenna, comprising:

a main disc having a main surface with arc-shaped;

a transmitting device disposed on the main disc and comprising a transmitter and a reflector having a reflecting surface which is arc-shaped and corresponds to the main surface of the main disc, wherein the transmitter corresponds to the reflector; and a reflecting member detachably engaged with the reflecting surface of the reflector, wherein the reflecting member corresponds to the transmitter.

2. The parabolic antenna as claimed in claim 1, further comprising an extending disc, wherein the extending disc has a first open side, a second open side, and an extending surface extending from the first open side toward the second open side; the main disc has an open side; the first open side of the extending disc is detachably engaged with the open side of the main disc; and the reflecting member corresponds to the extending surface.

3. The parabolic antenna as claimed in claim 2, wherein the extending disc comprises at least one mesh hole penetrating through the extending surface.

4. The parabolic antenna as claimed in claim 2, wherein the extending disc is formed by splicing a plurality of curved plates which forms the extending surface.

5. The parabolic antenna as claimed in claim 4, wherein a side of each of the curved plates has a first engaging portion and another side of each of the curved plates has a second engaging portion; the first engaging portion of the curved plates is engaged with the second engaging portion of the adjacent curved plates.

6. The parabolic antenna as claimed in claim 5, wherein the first engaging portion of each of the curved plates comprises a first folding edge, and the second engaging portion of each of the curved plates comprises a second folding edge; the first folding edge of each of the curved plates is engaged with the second folding edge of the adjacent curved plates via an engaging member; at least one positioning member is disposed on the first folding edge of the curved plate, and at least one positioning hole is disposed on the second folding edge of the curved plate; the at least one positioning member of the first folding edge of the curved plate penetrates through the at least one positioning hole of the second folding edge of the adjacent curved plate.

7. The parabolic antenna as claimed in claim 2, wherein the open side of the main disc has an engaging portion which is detachably engaged with the first open side of the extending disc.

8. The parabolic antenna as claimed in claim 7, wherein the engaging portion is an annular flange; a plurality of assembled holes is disposed on the annular flange along a circumferential direction of the annular flange.

9. The parabolic antenna as claimed in claim 1, wherein the reflecting member has a first end and a second end; the first end corresponds to the transmitter; the second end has an attaching surface abutting against the reflecting surface of the reflector; and an outer diameter of the reflecting member increases gradually from the first end toward the second end.

10. The parabolic antenna as claimed in claim 9, wherein the reflecting member is conical.

11. The parabolic antenna as claimed in claim 9, wherein the attaching surface is an arc-shape complementary to the reflecting surface.

12. The parabolic antenna as claimed in claim 1, further comprising a fixing mechanism, wherein the reflecting member is detachably engaged with the reflecting surface via the fixing mechanism.

13. The parabolic antenna as claimed in claim 12, wherein the reflector has a through-hole, and the reflecting member has a fixing hole corresponding to the through-hole; a fixing member passes through the through-hole to be engaged with the fixing hole; the through-hole, the fixing hole, and the fixing member constitute the fixing mechanism.

14. The parabolic antenna as claimed in claim 12, wherein the reflector has a fixing hole, and the reflecting member has a fixing rod disposed in the fixing hole, thereby to fix the reflecting member on the reflecting surface; the fixing hole and the fixing rod constitute the fixing mechanism.

15. The parabolic antenna as claimed in claim 1, wherein the transmitting device further comprises a wave-guided tube and a support; the wave-guided tube is engaged with the main disc; the support is disposed on an end of the wave-guided tube; the reflector is disposed on the support; and the support has a plurality of hollow portions.

* * * * *